US007864044B2

(12) United States Patent
Armstrong et al.

(10) Patent No.: US 7,864,044 B2
(45) Date of Patent: Jan. 4, 2011

(54) SYSTEM FOR MONITORING UNSUPERVISED WORKERS AND GENERATING AND DELIVERING A REPORT BASED ON THE MONITORED ACTIVITIES SUCH AS UTILIZING A THIRD PARTY SERVICE PROVIDER AND SYSTEM SUBSCRIPTION

(75) Inventors: Brian Stewart Randall Armstrong, Shorewood, WI (US); Jose Alejandro Gutierrez, St. Louis, MO (US)

(73) Assignee: Eaton Corporation, Cleveland, OH (US)

( * ) Notice: Subject to any disclaimer, the term of this patent is extended or adjusted under 35 U.S.C. 154(b) by 901 days.

(21) Appl. No.: 11/749,923

(22) Filed: May 17, 2007

(65) Prior Publication Data

US 2008/0284591 A1 Nov. 20, 2008

(51) Int. Cl.
*G08B 1/08* (2006.01)

(52) U.S. Cl. ..... 340/539.13; 340/539.15; 340/573.1

(58) Field of Classification Search ..... 340/539.13, 340/539.14, 539.15, 539.16, 539.17, 573.1
See application file for complete search history.

(56) References Cited

U.S. PATENT DOCUMENTS

| | | | |
|---|---|---|---|
| 6,144,288 | A | 11/2000 | Jahn et al. |
| 6,259,372 | B1 | 7/2001 | Taranowski et al. |
| 2005/0085180 | A1 | 4/2005 | Ballay et al. |
| 2005/0085248 | A1 | 4/2005 | Ballay et al. |
| 2005/0086366 | A1 | 4/2005 | Luebke et al. |

*Primary Examiner*—Jeffery Hofsass
(74) *Attorney, Agent, or Firm*—Martin J. Moran

(57) ABSTRACT

A system for monitoring an unsupervised worker is provided that includes a plurality of sensors and a base station provided at the monitored location, a service provider server located remotely from the monitored location and operated by a third party service provider, and a computing device associated with a subscriber to the system. At least a portion of the sensed data is sent to and stored by the service provider server so that a report based thereon may, at the request of the system subscriber, be selectively generated and provided to the system subscriber. The computing device is also adapted to generate configuration data for one or more of the sensors and transmit the configuration data to the service provider server. The configuration data is then sent to the base station and used to control the operation of the sensors.

19 Claims, 2 Drawing Sheets

SYSTEM FOR MONITORING UNSUPERVISED WORKERS AND GENERATING AND DELIVERING A REPORT BASED ON THE MONITORED ACTIVITIES SUCH AS UTILIZING A THIRD PARTY SERVICE PROVIDER AND SYSTEM SUBSCRIPTION

FIELD OF THE INVENTION

The present invention relates to monitoring systems, and in particular to a system implemented by a third party service provider for monitoring unsupervised workers, such as a babysitter, and generating and making reports of the sensed data available to the party employing the worker, such as a parent that hires a babysitter.

BACKGROUND OF THE INVENTION

A number of situations require workers to be left unsupervised for periods of time. Perhaps the most common such situation is when a parent or parents hire a babysitter to care for one or more children while they are away from their residence for a period of time. In such situations, the hiring party is often particularly concerned with knowing how well the worker or workers are following instructions. In the case of a babysitter, parents are most concerned with knowing whether rules are being followed and whether appropriate supervision of the children is being provided. For example, many parents are interested in knowing whether the children are watching too much television, using the computer too much, watching forbidden channels or playing forbidden computer games while the parents are away. Similarly, many parents are interested in knowing whether the babysitter sitter is watching television, instant messaging friends to talking on the telephone instead of minding the children. Currently, there is no system available for monitoring conditions in the workplace, such as a residence, wherein a third party service provider monitors certain conditions at the workplace, generates a report of those conditions, and makes the report readily available to the hiring party such as parent.

SUMMARY OF THE INVENTION

In one embodiment, the invention relates to a system for monitoring an unsupervised worker (such as a babysitter) working at a monitored location (such as a residence) of a system subscriber and generating and providing a report based on the monitoring. The system includes a plurality of sensors provided at the monitored location, each of the sensors being operatively coupled to an item located within or forming a part of the monitored location for generating sensed data relating to the respective item, and a base station provided at the monitored location. Each of the sensors is in at least one of wireless and wired communication with the base station to enable the sensors to transmit the respective sensed data generated thereby to the base station to create a compilation of sensed data at the base station. The system also includes a service provider server located remotely from the monitored location and operated by a third party service provider. The system subscriber has a service subscription with the third party service provider for the monitoring that is to be performed. The base station is in electronic communication with the service provider server through a network, and the service provider server receives at least a portion of the compilation of sensed data from the base station through the network and stores the at least a portion of the compilation of sensed data as stored sensed data. The service provider server is adapted to generate a report based on at least a portion of the stored sensed data. The system further includes a computing device under the control of the system subscriber and in electronic communication with the service provider server through the network. The computing device is adapted to: (i) selectively request and receive the report from the service provider server through the network, (ii) display the report, (iii) selectively generate configuration data for one or more of the sensors, and (iv) transmit the configuration data to the service provider server through the network. The configuration data is transmitted to the base station from the service provider server through the network and is used to control the operation of the one or more of the sensors.

The configuration data for each of the one or more of the sensors may establish one or both of the type of data that is collected by the sensor and an alarm condition that causes the sensor to issue an alarm signal. In one embodiment, one of the sensors is adapted to generate and transmit to the base station an alarm signal when one or more predetermined conditions are sensed thereby, and the base station is adapted to cause a second alarm signal to be transmitted directly to the computing device in response to receipt of the alarm signal. The computing device may be a wireless computing device located remotely from the monitored location, and the second alarm signal may be a phone call that includes synthesized speech or a text message.

In another embodiment, the invention provides a method of monitoring an unsupervised worker working at a monitored location of a system subscriber and generating and providing a report based on the monitoring. The method includes establishing a service subscription relationship between the system subscriber and a third party service provider for the monitoring that is to be performed, providing a plurality of sensors at the monitored location, each of the sensors being operatively coupled to an item located within or forming a part of the monitored location for generating sensed data relating to the respective item, and compiling the respective sensed data generated by the sensors to create a compilation of sensed data at the monitored location. The method further includes transmitting at least a portion of the compilation of sensed data from the monitored location to a service provider location remote from the monitored location, wherein the service provider location is operated by the third party service provider, and storing the at least a portion of the compilation of sensed data at the service provider location as stored sensed data. The method still further includes receiving a request from the system subscriber at the service provider location to generate a report based on at least a portion of the stored sensed data, generating the report at the service provider location, providing the report to the system subscriber, and receiving configuration data for one or more of the sensors from the third party service provider at the monitored location. The configuration data is based on data provided to the third party service provider by the system subscriber and is used to control the operation of the one or more of the sensors.

Also, the configuration data for each of the one or more of the sensors may establish one or both of the type of data that is collected by the each of the one or more sensors and an alarm condition that causes the each of the one or more sensors to issue an alarm signal. In one particular embodiment, one of the sensors is adapted to generate and transmit an alarm signal when one or more predetermined conditions are sensed thereby, and the method further includes causing a second alarm signal to be transmitted directly to a computing device under the control of the system subscriber in response to receipt of the alarm signal. The computing device may be a cell phone and the second alarm signal may be a phone call that includes synthesized speech, or, alternatively, the second alarm signal may be a text message transmitted to a remote computing device.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

Figure 1:
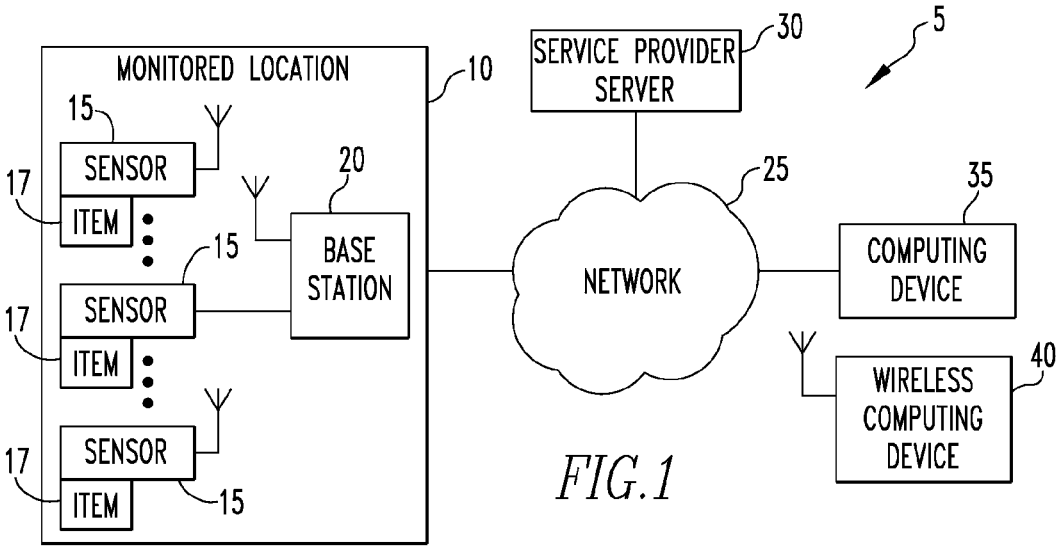
FIG. 1 is a block diagram of a monitoring system according to one embodiment of the present invention.

FIG. 1 is a block diagram of a monitoring system 5 according to one embodiment of the present invention. The monitoring system 5 is operated by a third party service provider and includes a monitored location 10 which is owned and/or controlled by a subscriber to the monitoring system 5 (as described elsewhere herein). The monitored location 10 is preferably a workplace location wherein an unsupervised worker to be monitored spends time and the subscriber is the employer of the unsupervised worker. In one particular embodiment, the unsupervised worker is a babysitter, the monitored location 10 is the residence of the children being babysat, and the subscriber is the parent or parents of the children being babysat. In the present system, as described in detail below, the third party service provider monitors the unsupervised worker and generates and delivers to the subscriber, for a fee, an information product which reports on the activities of the unsupervised worker. As employed herein, the term "residence" shall expressly include, but not be limited by, a home, apartment, dwelling, office and/or place where a person or persons reside(s) and/or work(s). As will be appreciated, other types of unsupervised workers, and therefore other types of subscribers, are also possible.

As seen in FIG. 1, the monitored location 10 includes a plurality of sensors 15 which are adapted to sense various types of data relating to the monitored location 10. The sensors 15 are each operatively coupled to an item located within or forming a part of the monitored location 10 (such as an electronic or mechanical device or a portion thereof located within the monitored location 10 or a portion of the monitored location 10 itself like a door or window) to sense data relating the item and therefore relating to the monitored location 10. For example, in one embodiment the monitored location 10 is a residence and the unsupervised worker being monitored is a babysitter. In that embodiment, the sensors 15 may include the following: (i) a sensor or sensors operatively coupled to a television within the monitored location 10 to detect data relating to television use, such as how long and at what times the television is being watched and what channels are being watched (parents may want to limit television use by children or may want to know when a babysitter is watching television rather than paying attention to children (e.g., television watching by the babysitter may be fine after the children's bedtime but not before)), (ii) a sensor or sensors operatively coupled to a personal computer within the monitored location 10 to detect data relating to computer use, such as how long and at what times the computer is being used and what programs (e.g., email, instant messaging, games, etc.), files and/or web sites are being accessed, (iii) a sensor or sensors operatively coupled to the telephone within the monitored location 10 to detect data relating to telephone use, such as how long and at what times the telephone was being used and what telephone numbers were dialed and/or from what telephone number calls were received (parents may want to limit telephone use by children or may want to know when a babysitter is talking on the telephone rather than paying attention to children (e.g., telephone use by the babysitter may be fine after the children's bedtime but not before)), (iv) a sensor or sensors operatively coupled to a child's bed within the monitored location 10 to detect data relating to when the child went to sleep and whether the child remained in his or her bed (such a sensor may take the form of a weight sensor placed under the mattress to detect when someone is in the bed), (v) a sensor or sensors operatively coupled to a medicine cabinet within the monitored location 10 to detect data relating to whether and when the medicine cabinet has been opened (parents would likely be interested in knowing any time that the medicine cabinet is opened), (vi) a sensor or sensors operatively coupled to a liquor cabinet within the monitored location 10 to detect data relating to whether and when the liquor cabinet has been opened, (vii) a sensor or sensors operatively coupled to a gun cabinet within the monitored location 10 to detect data relating to whether and when the gun cabinet has been opened, (viii) a sensor or sensors operatively coupled to the points of entry into the monitored location 10 (e.g., various door and/or windows) to detect whether and when they have been opened, and/or (ix) a sensor or sensors operatively coupled to a smoke or similar alarm within the monitored location 10 to detect data relating to whether and when the alarm was activated. As will be appreciated, the sensors 15 just described are meant to be exemplary only, and many other types of sensors 15 are possible. Examples of such sensors 15 and systems that employ such sensors 15 are described in the following published patent applications, the disclosures of which are incorporated herein by reference: United States Patent Application Publication No. 2005/0086366, entitled "Home System Including A Portable Fob Having A Display," United States Patent Application Publication No. 2005/0085248, entitled "Home System Including A Portable Fob Mating With System Components," and United States Patent Application Publication No. 2005/0085180, entitled "Home System Including A Portable Fob Having A Rotary Menu And A Display."

Referring again to FIG. 1, the monitored location 10 also includes a base station 20. The base station 20 includes a suitable processor, a memory, and a wireless communications device such as an RF transceiver. Each of the sensors 15 is adapted to communicate, either wirelessly, in a wired fashion, or both, with the base station 20. As employed herein, the term "wirelessly" shall expressly include, but not be limited by, radio frequency (RF), infrared, wireless area networks, IEEE 802.11 (e.g., 802.11a; 802.11b; 802.11g), IEEE 802.15 (e.g., 802.15.1; 802.15.3, 802.15.4), other wireless communication standards (e.g., without limitation, ZigBee™ Alliance standard), DECT, PWT, pager, PCS, Wi-Fi, Bluetooth™, and cellular. As a result, each sensor 15 is able to communicate data, such as the data that is sensed thereby, to and receive data, such as configuration data, from the base station 20. The sensors 15 are preferably adapted to operate in at least two different modes including a first mode where the sensor 15 logs certain data being sensed (e.g., how long and at what times the television is being watched and what channels are being watched) and periodically transmits that data to the base station 20, and a second mode wherein the sensor 15 is configured to monitor certain data/conditions and transmit an alarm signal to the base station when certain data/conditions are sensed (e.g., when a certain web site is accessed, when the smoke alarm goes off or when the front door is opened).

In addition, as seen in FIG. 1, the base station 20 is in wired and/or wireless electronic communication with a network 25, which may be, for example, the Internet, one or more private communications networks, or any combination thereof. As employed herein, the term "communications network" shall expressly include, but not be limited by, any local area network (LAN), wide area network (WAN), intranet, extranet, global communication network, the Internet, and/or wireless communication network. Preferably, the wired and/or wireless connection to the network 25 is secure (e.g., in the form of an encrypted virtual private network) and in an "always-on" mode. Alternatively, the wired and/or wireless connection to network 25 may be selectively enabled by the subscriber, such as when the subscriber is away from the monitored location 10. The monitoring system 5 further includes a service provider server 30 which is operated by a third party service provider providing the monitoring and report service to the subscriber that is described herein. The service provider server 30 is in electronic communication with the network 25, and therefore is able to receive data from and transmit data to the base station 20 through the network 25.

The monitoring system 5 further includes a subscriber computing device 35, such as a personal computer, that is in wired communication with the network 25 and/or a subscriber wireless computing device 40, such as a portable wireless communicating device that is adapted for wireless communication with the network 25. As employed herein, the term "portable wireless communicating device" shall expressly include, but not be limited by, any portable communicating device having a wireless communication port (e.g., a portable wireless device; a portable personal computer (PC); a Personal Digital Assistant (PDA); a data phone). As such, the subscriber computing device 35 and/or the subscriber wireless computing device 40 are able to receive data from and transmit data to the service provider server 30 through the network 25. The subscriber computing device 35 and/or the subscriber wireless computing device 40 may be located at some location remote from the monitored location 10, or, alternatively, may be located within the monitored location 10 (e.g., in the form a PC owned by the subscriber).

In operation, the sensors 15 sense certain data relating to aspects of the monitored location 10 as described elsewhere herein and transit that data to the base station 20. The base station 20 collects the data from the sensors 15 and periodically transmits the collected data to the service provider server 30 through the network 25. The service provider server 30 is, under the control of the third party service provider, adapted to compile the data it receives (preferably by storing it in an associated database) and generate a report based on that data. The report that is generated may be selectively and securely (e.g., password protected) accessed by the subscriber through the network 25 using either or both of the subscriber computing device 35 and/or the subscriber wireless computing device 40. Preferably, the network 25 is the Internet such that the report may be selectively accessed using the worldwide web via a web browser provided as part of the subscriber computing device 35 and/or the subscriber wireless computing device 40. In the preferred embodiment, when the subscriber desires a report, the subscriber communicates with the service provider server 30 through the network 25 (e.g., via a web page or pages) and specifies the time period that the report is to cover. In response, the service provider server 30 accesses the appropriate data and generates an appropriate report accordingly. Thus, the service provider server 30 includes at least the following functional components/capabilities: a database function, a data logging and mining function, a report generator function, a web server function, and a user interface function According to a further aspect of the invention, the subscriber is able to access the service provider server 30 (using either or both of the subscriber computing device 35 and/or the subscriber wireless computing device 40) to select certain options for the report that is generated, including the format of the report and/or the specific data that is to be included in the report. For example, the subscriber may select which particular sensor data is to be included in the report. Also, the subscriber is able to access the service provider server 30 (using either or both of the subscriber computing device 35 and/or the subscriber wireless computing device 40) to provide configuration data for one or more of the sensors 15. The configuration data may, for example, cause the particular sensor 15 to be turned on or off, and/or may specify what type of data is to be sensed/collected by the sensor 15 (e.g., the configuration data for a sensor 15 operatively coupled to a computer in the monitored location 10 may specify what type of data is to be collected, such as how long and at what times the computer is being used, the configuration data for a sensor 15 operatively coupled to a television in the monitored location 10 may specify what type of data is to be collected, such as how long and at what times the television is being watched (i.e., on) and what channels are being watched, etc.). In addition, as described elsewhere herein, a sensor 15 may be configured to monitor certain data and transmit an alarm signal to the base station 20 when certain data/conditions/events are sensed. The configuration data provided by the subscriber to the service provider server 30 may therefore include parameters that define when the alarm is to be triggered (e.g., trigger an alarm when the television has been on for more than 1 hour or when a particular channel is being watched). Once the configuration data is provided to the service provider server 30, it is transmitted to the base station 20 through the network 25. The base station 20 is then adapted to transmit the configuration data to the appropriate sensor 15 where it is stored and used to control the operation of the sensor 15 accordingly.

According to an aspect of the present invention, the base station 20 is adapted to transmit a signal directly to the subscriber wireless computing device 40, such as in the form of a cell phone call or a text message, when one of the sensors 15 senses a predetermined alarm condition and sends an alarm signal to the base station 20 as described above. For example, in the case of a cell phone call, synthesized speech may be used to report the sensed condition, and in the case of a text message, an appropriately worded passage may be used to report the sensed condition. In this sense, the subscriber is given immediate notice of the occurrence of the alarm condition. Alternatively, the base station 20 could, upon receiving an alarm signal from a sensor 15, transmit a signal to the service provider server 30 through the network 25 with the service provider server 30 then sending a signal to the subscriber wireless computing device 40, such as in the form of a cell phone call or a text message.

Figure 2:
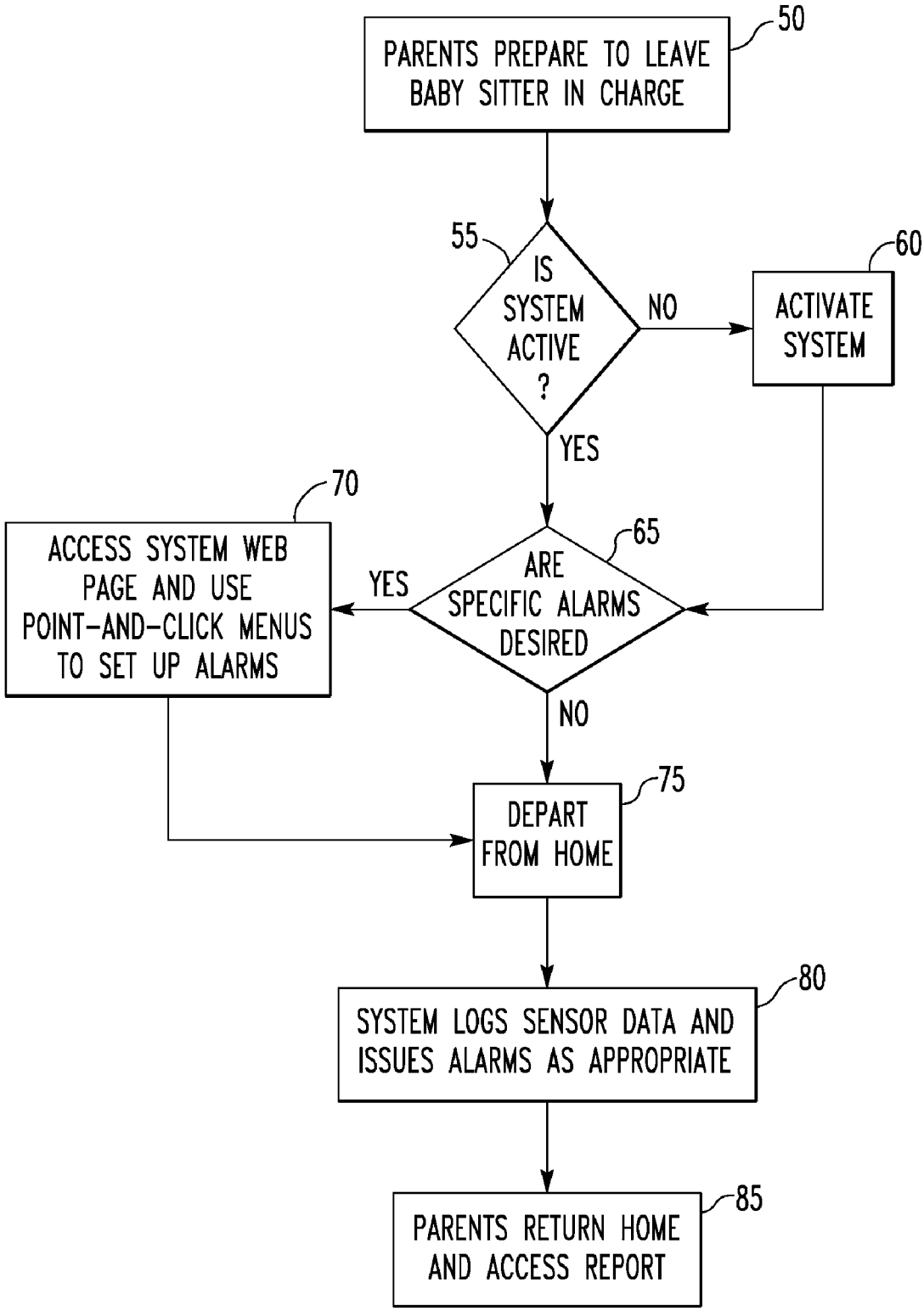
FIG. 2 is a flowchart illustrating the operation of the system shown in FIG. 1 according to one particular embodiment of the invention wherein the unsupervised worker is a babysitter

FIG. 2 is a flowchart illustrating the operation of the system 5 according to one particular embodiment of the invention wherein the unsupervised worker is a babysitter, the subscribers are the parents that hired the babysitter to watch their children, and the monitored location 10 is the subscriber's residence. At step 50, the parents prepare to leave home and leave the babysitter in charge. At step 55, a determination is made as to whether the system 5 is active, meaning is the communication of the sensor data from the base station 20 to the service provider server 30 enabled (e.g., is an always-on mode being employed). If the answer is no, then at step 60, the parents take steps to activate the system 5 by accessing an appropriate web page maintained by the service provider server 30 through either the subscriber computing device 35 or the subscriber wireless computing device 40. Following step 60 (or if the answer at step 55 is yes), a determination is made, at step 65, as to whether specific alarms are desired by the parents (e.g., do they want to receive notification that the front door has been opened or that the liquor cabinet or the medicine cabinet has been opened, among other possible alarms). If the answer at step 65 is yes, then, at step 70, the parents access an appropriate web page maintained by the service provider server 30 through either the subscriber computing device 35 or the subscriber wireless computing device 40 and set the desired alarms using, for example, point-and-click menus. Following step 70 (or if the answer at step 65 is no), the parents depart the residence at step 75. While the parents are away, the system 5, at step 80, measures sensor data at the monitored location 10 and transmits the data to the service provider server 30 for storage as described elsewhere herein. Then, at step 85, the parents are able to access a report compiled by the service provider server 30 when desired, preferably, although not necessarily, when they return home, using either the subscriber computing device 35 or the subscriber wireless computing device 40.

Figure 3:
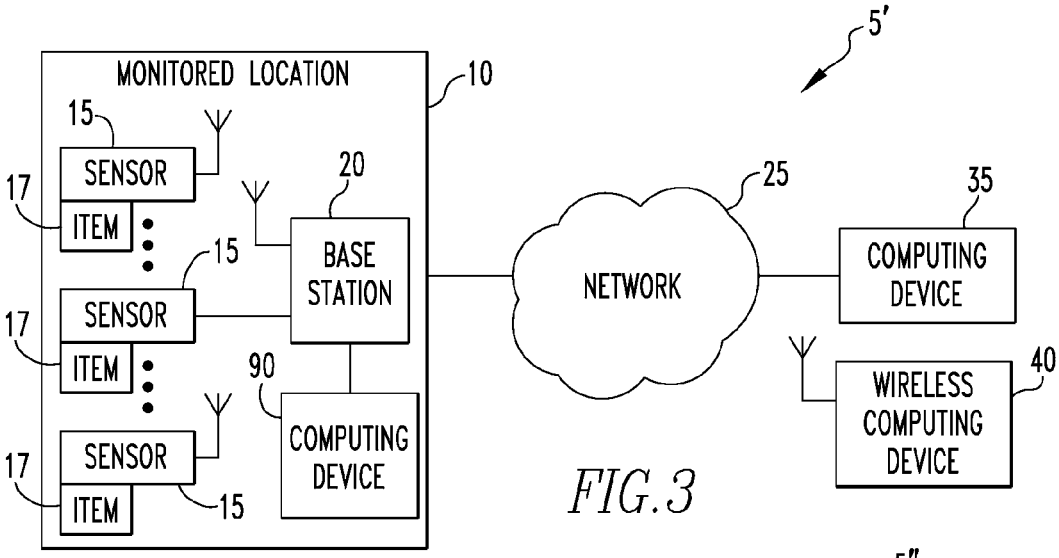
FIG. 3 is a block diagram of a monitoring system according to an alternative embodiment of the present invention.
Figure 4:
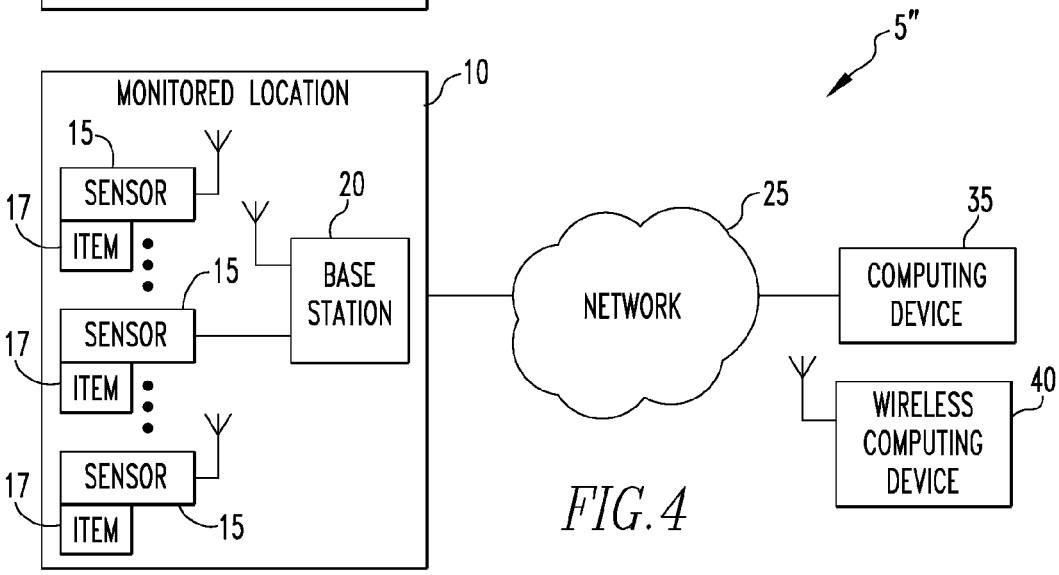
FIG. 4 is a block diagram of a monitoring system according to a further alternative embodiment of the present invention.

According to one alternative embodiment, shown in FIG. 3 as system 5', the main server 30 may be eliminated, and its functionality (e.g., data mining and logging and report generation) as described herein may be provided by a computing device 90, such as a PC, located at the monitored location 10. The computing device 90 may actually be the subscriber computing device 35. In another alternative embodiment, shown in FIG. 4 as system 5", the main server 30 may be eliminated, and its functionality (e.g., data mining and logging and report generation) as described herein may be provided by the base station 20. In this embodiment, the base station 20 may be accessed (through a web browser interface in a known manner) by either the subscriber computing device 35 or the subscriber wireless computing device 40 for the purposes described herein through the network 25. Also in this embodiment, the base station is provided with the appropriate hardware and software components (e.g., appropriate memory and a database and other software applications) that are required for providing the described functionality. These embodiments are advantageous in that a secure, "always-on" network connection to the main server 30 is not required.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A system for monitoring an unsupervised worker working at a monitored location of a system subscriber and generating and providing a report based on the monitoring, the system comprising:

a plurality of sensors provided at said monitored location, each of said sensors being operatively coupled to an item located within or forming a part of the monitored location for generating sensed data relating to the respective item;

a base station provided at said monitored location, each of said sensors being in at least one of wireless and wired communication with said base station to enable said each of said sensors to transmit the respective sensed data generated thereby to said base station to create a compilation of sensed data at said base station, a service provider server located remotely from said monitored location and operated by a third party service provider, said system subscriber having a service subscription with said third party service provider for the monitoring, said base station being in electronic communication with said service provider server through a network, said service provider server receiving at least a portion of said compilation of sensed data from said base station through said network and storing said at least a portion of said compilation of sensed data as stored sensed data, said service provider server being adapted to generate a report based on at least a portion of said stored sensed data; and a computing device under the control of said system subscriber and in electronic communication with said service provider server through said network, said computing device being adapted to: (i) selectively request and receive said report from said service provider server through said network, (ii) display said report, (iii) selectively generate configuration data for one or more of said sensors, and (iv) transmit said configuration data to said service provider server through said network;

wherein said configuration data is transmitted to said base station from said service provider server through said network and wherein said configuration data is received by said base station and used to control the operation of said one or more of said sensors.

2. The system according to claim 1, wherein the configuration data for each of said one or more of said sensors establishes one or both of the type of data that is collected by said each of said one or more sensors and an alarm condition that causes said each of said one or more sensors to issue an alarm signal.

3. The system according to claim 1, wherein one of said sensors is adapted to generate and transmit to said base station an alarm signal when one or more predetermined conditions are sensed thereby, and wherein said base station is adapted to cause a second alarm signal to be transmitted directly to said computing device in response to receipt of said alarm signal.

4. The system according to claim 3, wherein said computing device is a wireless computing device located remotely from said monitored location.

5. The system according to claim 4, wherein said wireless computing device is a cell phone and wherein said second alarm signal is a phone call that includes synthesized speech.

6. The system according to claim 4, wherein said second alarm signal is a text message.

7. The system according to claim 1, wherein one of said sensors is adapted to generate and transmit to said base station an alarm signal when one or more predetermined conditions are sensed thereby, and wherein said base station is adapted to cause a second alarm signal to be transmitted directly to a wireless computing device located remotely from said monitored location in response to receipt of said alarm signal.

8. The system according to claim 7, wherein said wireless computing device is a cell phone and wherein said second alarm signal is a phone call that includes synthesized speech.

9. The system according to claim 7, wherein said second alarm signal is a text message.

10. The system according to claim 1, wherein said unsupervised worker is a babysitter and wherein said monitored location is a residence.

11. The system according to claim 1, wherein said service provider server is adapted to generate said report in the form of one or more web pages accessible through said network, and wherein said computing device is adapted to selectively request and receive said one or more web pages from said service provider server through said network.

12. A method of monitoring an unsupervised worker working at a monitored location of a system subscriber and generating and providing a report based on the monitoring, the method comprising:

establishing a service subscription relationship between said system subscriber and a third party service provider for the monitoring;

providing a plurality of sensors at said monitored location, each of said sensors being operatively coupled to an item located within or forming a part of the monitored location for generating sensed data relating to the respective item;

compiling the respective sensed data generated by the sensors to create a compilation of sensed data at said monitored location;

transmitting at least a portion of said compilation of sensed data from said monitored location to a service provider location remote from said monitored location, said service provider location being operated by said third party service provider;

storing said at least a portion of said compilation of sensed data at said service provider location as stored sensed data;

receiving a request from said system subscriber at said service provider location to generate a report based on at least a portion of said stored sensed data;

generating said report at said service provider location;

providing said report to said system subscriber; and receiving configuration data for one or more of said sensors from said third party service provider at said monitored location, said configuration data being based on data provided to said third party service provider by said system subscriber, said configuration data being used to control the operation of said one or more of said sensors.

13. The method according to claim 12, wherein said step of providing said report to said subscriber comprises transmitting said report to a computing device under the control of said system subscriber, and wherein said data provided to said third party service provider by said system subscriber is transmitted to said service provider location and said configuration data is transmitted from said service provider location to said monitored location.

14. The method according to claim 12, wherein the configuration data for each of said one or more of said sensors establishes one or both of the type of data that is collected by said each of said one or more sensors and an alarm condition that causes said each of said one or more sensors to issue an alarm signal.

15. The method according to claim 12, wherein one of said sensors is adapted to generate and transmit an alarm signal when one or more predetermined conditions are sensed thereby, the method further comprising causing a second alarm signal to be transmitted directly to a computing device under the control of said system subscriber in response to receipt of said alarm signal.

16. The method according to claim 15, wherein said computing device is a wireless computing device located remotely from said monitored location.

17. The method according to claim 16, wherein said wireless computing device is a cell phone and wherein said second alarm signal is a phone call that includes synthesized speech.

18. The method according to claim 16, wherein said second alarm signal is a text message.

19. The method according to claim 12, wherein said steps of generating said report at said service provider location and providing said report to said system subscriber includes generating said report in the form of one or more web pages accessible over a network and providing said one or more web pages to said system subscriber through said network upon request.

* * * * *